US007927193B2

(12) United States Patent
Mikrut

(10) Patent No.: US 7,927,193 B2
(45) Date of Patent: Apr. 19, 2011

(54) BACKUP ASSEMBLY FOR A SANDING DEVICE

(76) Inventor: Ryszard Mikrut, Flushing, NY (US)

( * ) Notice: Subject to any disclaimer, the term of this patent is extended or adjusted under 35 U.S.C. 154(b) by 378 days.

(21) Appl. No.: 12/177,013

(22) Filed: Jul. 21, 2008

(65) Prior Publication Data

US 2010/0015901 A1 Jan. 21, 2010

(51) Int. Cl.
*B24B 23/00* (2006.01)

(52) U.S. Cl. ..... 451/490; 451/359

(58) Field of Classification Search ..... 451/490, 451/353, 359, 508, 509, 486
See application file for complete search history.

(56) References Cited

U.S. PATENT DOCUMENTS 2,164,418 A * 7/1939 Georges ..... 451/490
3,517,466 A * 6/1970 Bouvier ..... 451/490

* cited by examiner

*Primary Examiner* — Robert Rose
(74) *Attorney, Agent, or Firm* — Ostrolenk Faber LLP

(57) ABSTRACT

A back-up assembly for a sanding device, where the back-up assembly includes a driving disk rotating around a rotational axis, rigid segment plates, a flexible pad layer positioned between the rigid segment plates and the driving disk, and semi-flexible wedges located at the bottom of each rigid segment plate. Rigid segment plates are arranged circumferentially and spacedly around the rotational axis of the driving disk and are secured to the bottom surface of the driving disk by the flexible pad layer. Further, adjacent rigid segment plates are allowed to move with respect to each other in a direction parallel to the rotational axis of the driving disk.

21 Claims, 5 Drawing Sheets

BACKUP ASSEMBLY FOR A SANDING DEVICE

BACKGROUND OF THE INVENTION

This application relates to a power floor or wall, sanding, buffing, leveling or polishing apparatus, and, particularly, to a back-up assembly unit which carries a sandpaper disc in a power sander. The term "sander" (or sanding) encompasses grinding, planing, buffing, leveling, polishing, and the like.

Conventionally known power sanders include a drive mechanism and a back-up pad with an abrasive disc secured thereto. Coated abrasive back-up pads known in the art include a support surface to which sheets having coated abrasive material on one surface and pressure sensitive adhesive on the other may be releasably adhered. Typically the support surface is formed on a flexible polymeric adhesion layer attached to one surface of a layer of resiliently compressible foam. The back-up pad has a rigid annular backing plate attached to an opposite surface of the layer of foam. The back-up pad is then attached to the drive mechanism by a circular array of screws so that the drive mechanism can be used to drive the pad with the abrasive against a surface to be abraded, while the layer of foam provides a flexible cushion causing the abrasive to follow and level the contour of that surface. Such back-up pads are commercially available from National Detroit, Detroit, Mich., and typically include a backing plate made of aluminum, which can bend if the pad is dropped or otherwise impacted edgewise against a solid surface. In another commercially available back-up pad (available from Eezer, Fresno, Calif.), the backing plate is made of a fiber reinforced polymeric material (i.e., fiberglass reinforced epoxy), which can withstand such impacts.

The above-described commercially available back-up pads having solid rigid backing plates tend to level out both large and small curvatures of the surface to be sanded. However, while it may be advantageous to remove smaller curvatures to create a smoother resulting surface, trying to smooth out larger curvatures and slopes results in an unnecessary waste of material, especially when used on wood surfaces. Further, sanding of large curvatures with a sanding device having a rigid plate may results in a larger (and, possibly, unsafe) counterforce acting against the user of the device. Alternatively, when the abrasive disc is secured to the foam skin layer (i.e., the layer which is very flexible), some sections of the foam may be less flexible than adjacent portions of the foam. This results in areas of greater pressure alternating with areas of lesser pressure. Accordingly, when the such flexible pad is used to press moving abrasive material against a surface it results in uneven grinding of the surface.

One conventional example of a back-up assembly is disclosed in U.S. Pat. No. 3,808,753, which discloses a rotary abrasive tool with a flexible coated adhesive disc and a backing assembly. The flexible coated abrasive disc is mounted in the assembly outwardly of a slotted flexible backing disc or pad member which is provided with radially arranged circumferentially spaced slots which extend only partially through the body of the slotted flexible backing disc in the outer peripheral or marginal portion thereof. The slotted, flexible backing disc or pad member is adhesively attached to a second solid or unslotted backing disc or pad member. A second slotted backing disc or pad member is attached to the solid unslotted backing disc at the rear of the solid disc. Radially arranged slots in the two flexible slotted backing discs or pad members are staggered circumferentially relative to each other. Because the unslotted backing disc is formed solid, it suffers from the same drawbacks as described above with respect to back-up assemblies having a rigid backing plate.

Accordingly, there is a need in the art to provide a back-up assembly providing enough rigidity to accomplish smooth and even sanding of curved and uneven surfaces, while allowing for a safe operation and having adequate flexibility during sanding of relatively large curvatures.

SUMMARY OF THE INVENTION

In general, in a first aspect, the invention features a back-up assembly for a sanding device, where the back-up assembly includes a driving disk rotating around a rotational axis, rigid segment plates, a flexible pad layer positioned between the rigid segment plates and the driving disk, and semi-flexible wedges located at the bottom of each rigid segment plate. Rigid segment plates are arranged circumferentially and spacedly around the rotational axis of the driving disk and are secured to the bottom surface of the driving disk by the flexible pad layer. Further, adjacent rigid segment plates are allowed to move with respect to each other in a direction parallel to the rotational axis of the driving disk.

In general, in a second aspect, the invention features a back-up assembly for a sanding device, where the back-up assembly includes a driving disk rotating around a rotational axis in a rotational direction, rigid segment plates forming a non-uniform annular-shaped rigid disc layer, and flexible pads positioned between the rigid segment plates and the driving disk to secure the rigid segment plates to the driving disk. Each rigid segment plate has at least one edge, which is inclined at an angle $\alpha$ with respect to a central radius of the driving disk.

The above aspects, advantages and features are of representative embodiments only. It should be understood that they are not to be considered limitations on the invention as defined by the claims. Additional features and advantages of the invention will become apparent in the following description, from the drawings, and from the claims.

Other features and advantages of the present invention will become apparent from the following description of the invention, which refers to the accompanying drawings.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION OF THE PREFERRED EMBODIMENTS AND THE DRAWINGS

Figure 1:
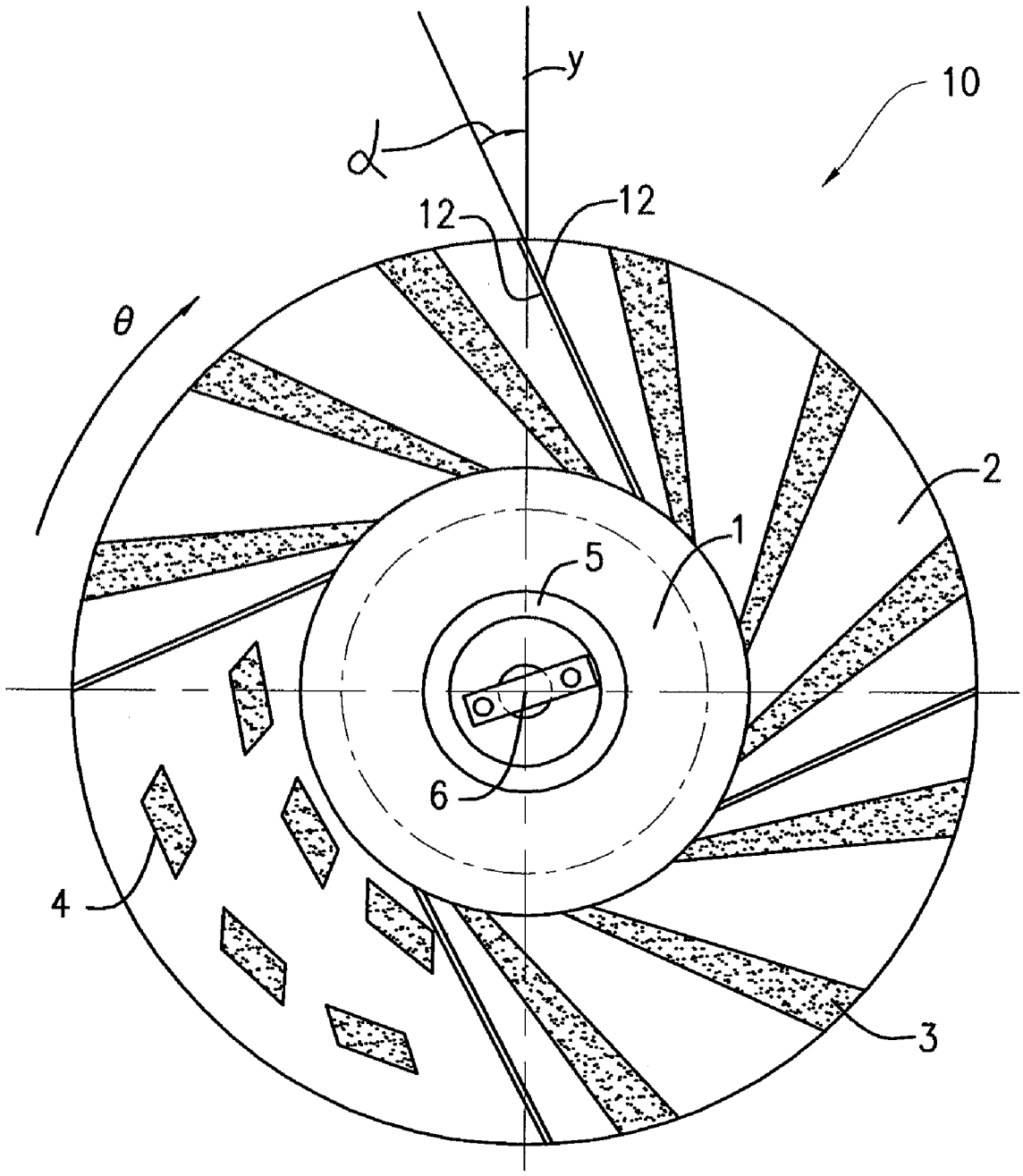
FIG. 1 is a bottom view of the back-up assembly for a sanding device with one of the rigid segment plates being removed from the flexible pads.
Figure 5:
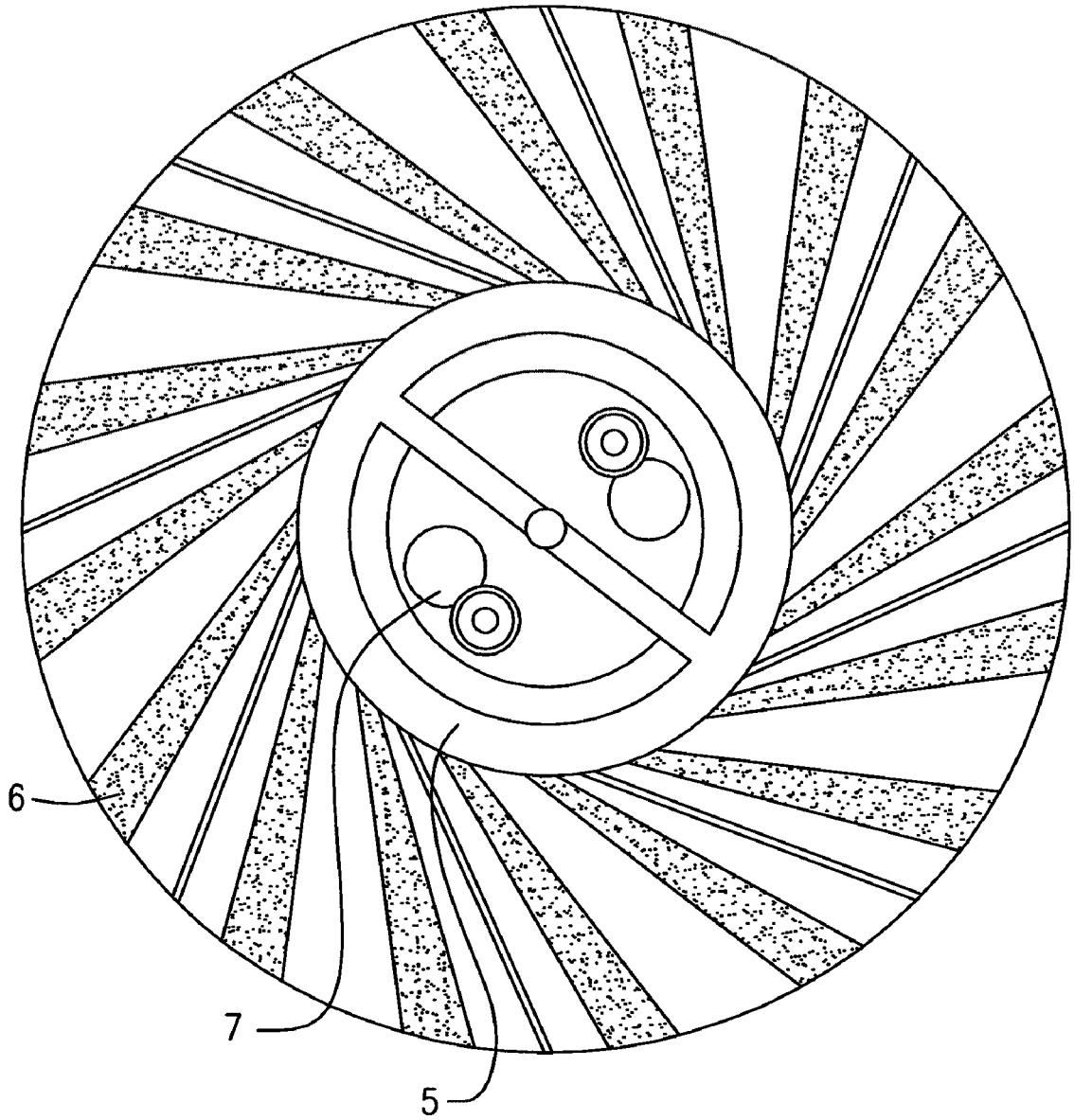
FIG. 5 is a bottom view of the back-up assembly with the attached abrasive sanding disc.

As shown in FIG. 1, a back-up assembly 10 for a sanding device includes a driving disk 1 rotating around a rotational axis in the rotational direction θ. In operation, driving disk 1 is coupled with a motor of the sanding device (not shown), to enable the rotation. The sanding device may be a floor sander, a wall sander or any other similar sanding device. Driving disk 1 preferably includes a collar 5 and a screw assembly 6. The collar and the screw assembly are used to attach an abrasive sanding disc 7 to the back-up assembly 10, as shown in FIG. 5. Any alternative sanding disc attachment mechanism known in the art may be utilized with the assembly 10 instead of the collar and screw assembly.

Figure 4:
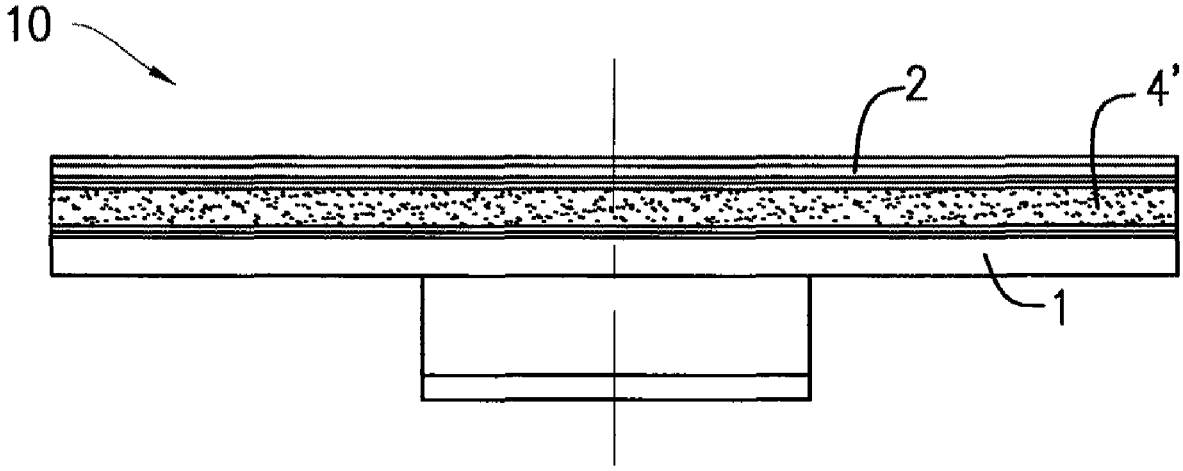
FIG. 4 is a side view of the back-up assembly having a uniform flexible layer.

Assembly 10 further includes rigid back-up plate segments 2 and flexible pads 4 positioned between the plate segments and the bottom surface of the driving disk. Each flexible pad 4 is secured to the bottom surface of the driving disk 1, for example, using an adhesive. Alternatively, flexible pads 4 may be removably secured to the bottom surface of the driving disk, for example, using a pressure sensitive adhesive or a hook-and-loop attachment. Pads 4 are preferably made of soft flexible material, for example, sponge rubber. Other flexible support mechanisms, however, may be used with the assembly 10 instead of the flexible pads. For example, mechanical coupling, such as a plurality of springs, may be utilized. Further, as shown in FIG. 4, a uniform flexible layer 4' may be used instead of multiple discrete flexible pads 4. Pads 4 may have varying softness and may be strategically placed along the bottom surface of the driving disk 1 so as to ensure the best sanding results.

Figure 2A:
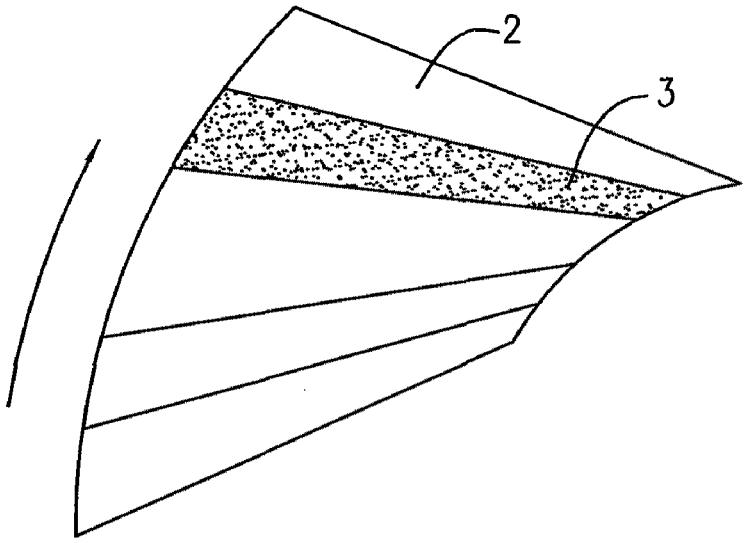
FIG. 2*a* is a bottom view of a rigid segment plate with semi-flexible wedges.
Figure 2B:
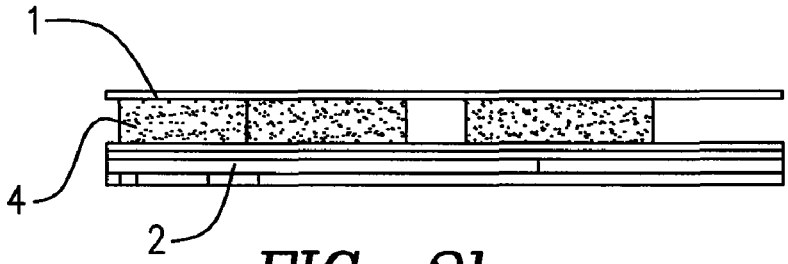
FIG. 2*b* is a side view of a rigid segment plate secured to the driving disk.
Figure 2C:
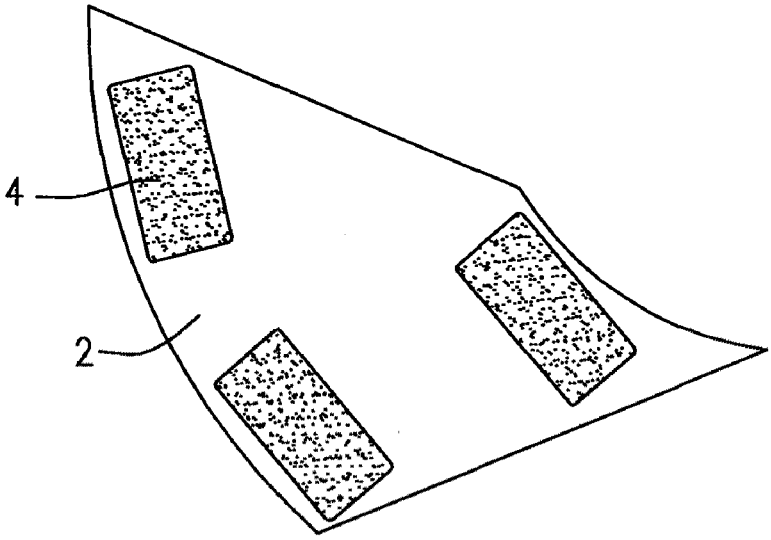
FIG. 2*c* is a top view of the rigid segment plate of FIG. 2*a* with flexible pads attached.

Rigid back-up plate segments 2 are secured to the flexible pads 4, preferably using an adhesive. A rigid back-up plate segment 2 is shown in detail in FIGS. 2*a*-2*c*. While a plate segment 2 may be a circular sector, i.e., a portion of a circle cut out by two radii, it is preferable that plate segments 2 are cut out such that their edges are inclined with respect to the radial lines of the back-up assembly circle. For example, as shown in FIG. 1, edges 12 of the plate segment 2 are inclined with respect to the central vertical radius Y at an angle α. Angle α is preferably within the 0°-75° range. Moreover, edges 12 are preferably inclined in a direction opposite to the direction of rotation θ of the back-up assembly 10.

Figure 3B:
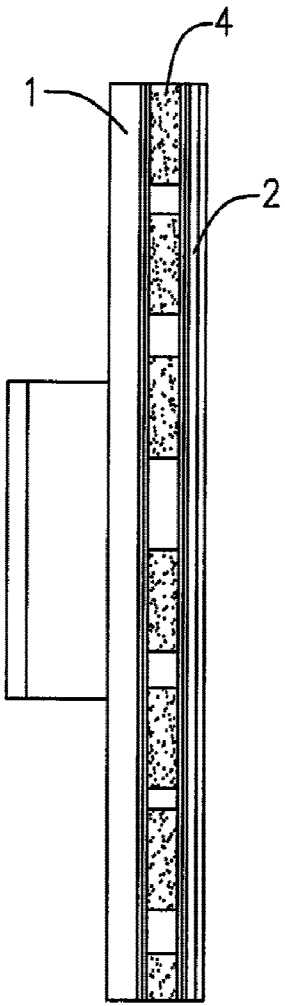
FIG. 3*b* is a side view of the back-up assembly having the non-uniform rigid layer of FIG. 3*a*.
Figure 3A:
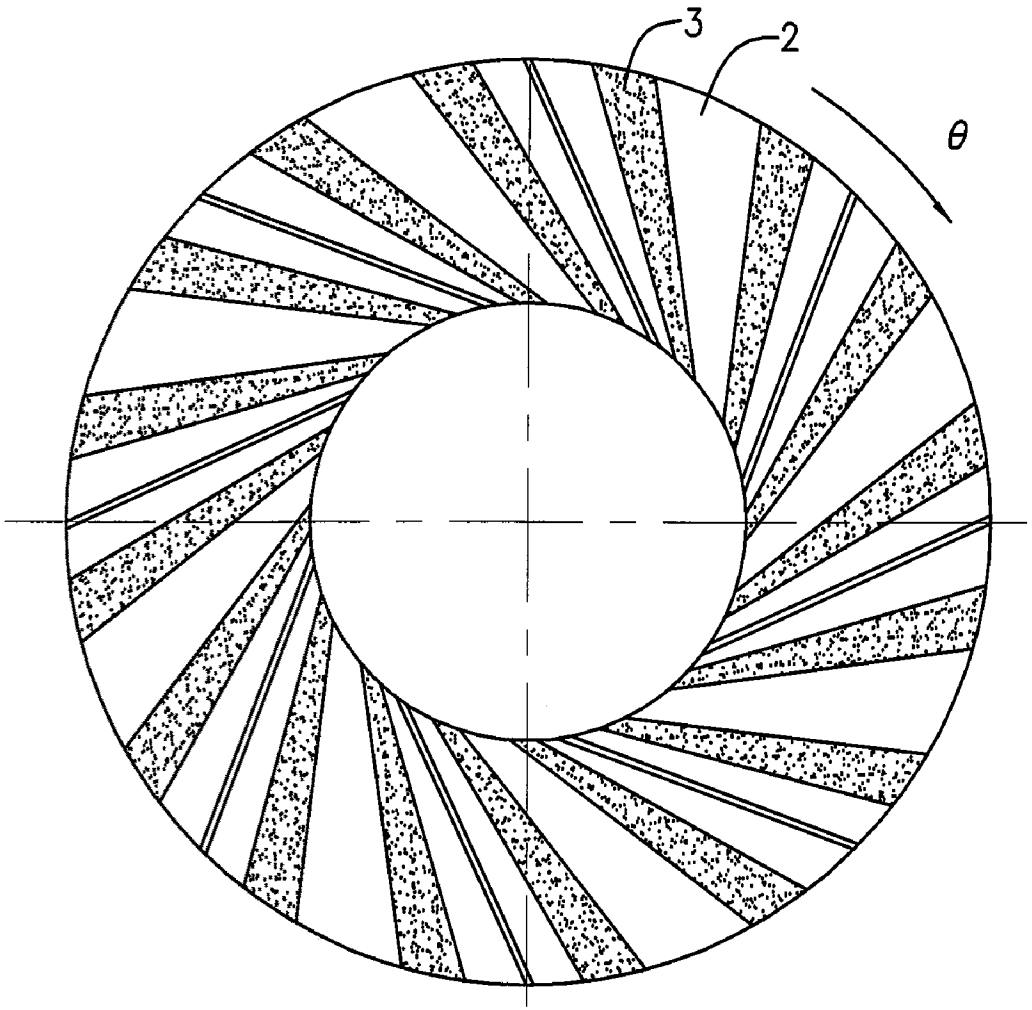
FIG. 3*a* is a bottom view of the non-uniform rigid layer formed with multiple rigid segment plates.

When plate segments 2 are all positioned at the bottom surface of the driving disk 1, they form a non-uniform annular-shaped rigid disc layer, as shown in FIGS. 3*a* and 3*b*, with edges 12 of the adjacent plate segments overrunning each other. While the rigidity of each plate segment enables a rigid back-up support for the abrasive disc 7, plate segments 2 also allow for a relative flexibility during operation of the sending device. Specifically, due to the flexibility of pads 4, when pressure is applied to a particular plate segment 2, this plate segment has a small give with respect to its adjacent plate segments 2. Thus, during operation, adjacent plate segments can move relative to each other in the direction parallel to the rotational axis of the driving disk, allowing for a smoother operation of the sending device, especially over an uneven surface to be sanded. The number of the plate segments 2 forming the rigid disc layer depends on the desired final quality of the sanded surface. A larger number of the plate segments results in a smother sanded surface. In other words, the smaller the size of each rigid plate segment, the smother the resulting surface.

Rigid plate segments 2 are preferably made of aluminum, stainless steel or fiber reinforced polymeric material. Any alternative suitable material known in the art may also be utilized.

Further, each rigid plate segment 2 is preferably provided with multiple wedges 3 fixedly secured to the surface of the plate segment. Wedges 3 are preferably semi-flexible and are made of rubber (other than the sponge rubber). In the preferred embodiment, wedges 3 are preferably less flexible (i.e., have less give) than flexible pads 4. The abrasive sanding disc 7 is secured to the surfaces of the wedges 3. A two-sided sanding disc or a disc with a pressure sensitive adhesive or a hook-and-loop attachment may be used for this purpose. During operation, wedges 3 provide an additional flexible cushion causing the abrasive sanding disc to follow and level the contour of the surface being sanded.

As described above, an important purpose of the assembly of the present disclosure is flattening or leveling of the surface of the flooring to remove chatter marks, waves irregularities caused by drum sending machines of the prior art.

If you are a number of rigid segments produce a flatter surface of the sanded flooring. Only the rubber wedges (are equivalent) force the sandpaper toward the surface being sanded and because the wedges may be very narrow (with their total surface comprising ⅓ or even less than the total surface of the sanding disclosed) considerable faster sanding and a more level of flooring is obtained.

Since only a portion of the sanding paper is being used at one particular setting, once worn, the sanding paper can be turned at least two more times to get the unused portions thereof over the wedges in order to fully utilize each sanding paper sheet. Also, the shape and arrangement of the wedges create one rigid surface when turning, which results in a highly level and flattened sanded surface.

Thus, unlike the prior art where soft sponge rubber presses a sandpaper directly against a floor and a percent of the sandpaper assumes the surface of the even floor, in the presently described device a rigid member backed up by several softer sponges creates a leveled surface that removes all waviness and unevenness from the sanded surface.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Other undescribed variations or modifications may be possible. For example, where multiple alternative embodiments are described, in many cases it will be possible to combine elements of different embodiments, or to combine elements of the embodiments described here with other modifications or variations that are not expressly described. Many of those undescribed variations, modifications and variations are within the literal scope of the following claims, and others are equivalent.

What is claimed is:

1. A back-up assembly for a sanding device, the back-up assembly comprising:

a driving disk rotatable around a rotational axis in a rotational direction;

a plurality of independent rigid and flat segment plates arranged circumferentially and spacedly around the rotational axis; and at least one respective flexible pad layer positioned between a first surface of each of the rigid segment plates and the driving disk, the flexible pad layer securing the rigid segment plates to the driving disk, wherein adjacent rigid segment plates are independently coupled to the driving disk and independently pivotable relative thereto, and a plurality of semi-flexible wedges secured to a second surface of each rigid segment plate, the second surface of each rigid segment plate being opposite to the first surface.

2. A back-up assembly for a sanding device, the back-up assembly comprising:

a driving disk rotatable around a rotational axis in a rotational direction;

a plurality of independent rigid and flat segment plates arranged circumferentially and spacedly around the rotational axis; and at least one respective flexible pad layer positioned between a first surface of each of the rigid segment plates and the driving disk, the flexible pad layer securing the rigid segment plates to the driving disk, wherein adjacent rigid segment plates are independently coupled to the driving disk and independently pivotable relative thereto, wherein the flexible pad layer comprises a plurality of flexible pads, and wherein each rigid segment plate comprises at least one edge which is inclined with respect to a central radius of the driving disk at an angle a.

3. The back-up assembly according to claim 2, wherein the angle a is in a range of 0°-75°.

4. The back-up assembly according to claim 2, wherein adjacent inclined edges of adjacent rigid segment plates overrun each other.

5. The back-up assembly according to claim 2, wherein the at least one inclined edge is inclined in a direction opposite from the rotational direction of the driving disk.

6. The back-up assembly according to Claim 1, wherein each of the flexible pads is formed of sponge rubber.

7. The back-up assembly according to Claim 1, wherein each of the flexible pads is a metal spring.

8. The back-up assembly according to Claim 1, wherein the flexible pad layer comprises at least one air cushion.

9. The back-up assembly according to Claim 1, wherein the flexible pad layer comprises a resilient material.

10. The back-up assembly according to claim 1 further comprising an abrasive sanding disc secured to the semi-flexible wedges.

11. The back-up assembly according to claim 10, wherein the driving disk further comprises a collar and a screw assembly, the collar and the screw assembly securing the abrasive sanding disc to the driving disk.

12. The back-up assembly according to claim 10, wherein the abrasive sanding disc is secured to the semi-flexible wedges using a hook-and-loop attachment.

13. A back-up assembly for a sanding device, the back-up assembly comprising:

a driving disk rotating around a rotational axis in a rotational direction and having a bottom surface;

a plurality of independent rigid segment plates arranged circumferentially and spacedly around the rotational axis, each rigid segment plate having a top surface, a bottom surface and at least one edge which is inclined at an angle a with respect to a central radius of the driving disk; and a plurality of flexible pads positioned between the rigid segment plates and the driving disk and securing the top surfaces of the rigid segment plates to the bottom surface of the driving disk.

14. The back-up assembly according to claim 13, wherein the angle a is in a range of 0°-75°.

15. The back-up assembly according to claim 13, wherein adjacent inclined edges of adjacent rigid segment plates overrun each other.

16. The back-up assembly according to claim 13, wherein the at least one inclined edge is inclined in a direction opposite from the rotational direction of the driving disk.

17. The back-up assembly according to claim 13, wherein each of the flexible pads is formed of sponge rubber.

18. The back-up assembly according to claim 13 further comprising an abrasive sanding disc secured to the bottom surfaces of the rigid segment plates.

19. The back-up assembly according to claim 18, wherein the driving disk further comprises a collar and a screw assembly, the collar and the screw assembly securing the abrasive sanding disc to the driving disk.

20. The back-up assembly according to claim 18, wherein the abrasive sanding disc is secured to the bottom surfaces of the rigid segment plates using a hook-and-loop attachment.

21. The back-up assembly according to claim 13, wherein adjacent rigid segment plates are movable with respect to each other in a direction parallel to the rotational axis of the driving disk.

* * * * *